US009510665B2

(12) United States Patent
Lombardi

(10) Patent No.: US 9,510,665 B2
(45) **Date of Patent: *Dec. 6, 2016**

(54) TOOTHBRUSH

(71) Applicant: Stephen Lombardi, Bronx, NY (US)

(72) Inventor: Stephen Lombardi, Bronx, NY (US)

( * ) Notice: Subject to any disclaimer, the term of this patent is extended or adjusted under 35 U.S.C. 154(b) by 362 days.

This patent is subject to a terminal disclaimer.

(21) Appl. No.: 14/182,861

(22) Filed: Feb. 18, 2014

(65) Prior Publication Data

US 2014/0157537 A1 Jun. 12, 2014

Related U.S. Application Data

(63) Continuation of application No. 12/927,652, filed on Nov. 20, 2010, now Pat. No. 8,650,697.

(51) Int. Cl.

| | |
|---|---|
| ***A46B 9/04*** | (2006.01) |
| ***A46B 5/00*** | (2006.01) |
| ***A46B 17/06*** | (2006.01) |

(52) U.S. Cl.

CPC ..... *A46B 9/04* (2013.01); *A46B 5/0041* (2013.01); *A46B 17/065* (2013.01); *A46B 2200/1066* (2013.01)

(58) Field of Classification Search

CPC .... A46B 9/04; A46B 5/0041; A46B 17/065; A46B 2200/1066; A46B 5/02

See application file for complete search history.

(56) References Cited

U.S. PATENT DOCUMENTS

| | | | | |
|---|---|---|---|---|
| 1,956,477 | A | 4/1934 | Segal | |
| 2,247,003 | A | 9/1940 | Smith et al. | |
| 5,228,166 | A * | 7/1993 | Gomez | A46B 5/02 15/167.1 |
| 5,956,796 | A * | 9/1999 | Lodato | A46B 5/00 15/143.1 |
| 8,650,697 | B2 * | 2/2014 | Lombardi | A46B 5/0041 15/143.1 |
| 2005/0274906 | A1 | 12/2005 | Riddell | |
| 2008/0060153 | A1 * | 3/2008 | Jansheski | A46B 17/06 15/105 |
| 2009/0083924 | A1 | 4/2009 | Shepherd et al. | |
| 2010/0325828 | A1 * | 12/2010 | Braun | A46B 15/0012 15/167.1 |
| 2011/0162155 | A1 * | 7/2011 | Wai | A46B 15/0002 15/4 |

FOREIGN PATENT DOCUMENTS

| | | |
|---|---|---|
| CN | 2699728 Y | 5/2005 |

* cited by examiner

*Primary Examiner* — Robert Scruggs

(74) *Attorney, Agent, or Firm* — Abelman, Frayne & Schwab

(57) ABSTRACT

A toothbrush having a substantially vertical orientation while at rest on a supporting surface, including a body having one end provided with a tooth-brushing element and another opposite end, said body having at least a part configured so that when the toothbrush is inclined, even close to a horizontal position, the toothbrush automatically self erects to the substantially vertical orientation to prevent a contact of said tooth-brushing element with the supporting surface.

20 Claims, 2 Drawing Sheets

TOOTHBRUSH

CROSS REFERENCE TO RELATED APPLICATION

This application is a continuation of U.S. application Ser. No. 12/927,652, filed Nov. 20, 2010, now pending, the disclosure of which is incorporated by reference in its entirety.

FIELD OF INVENTION

The present invention relates generally to toothbrushes.

BACKGROUND OF THE INVENTION

Toothbrushes are widely used for brushing teeth and known in many modifications. It is advisable to hold the toothbrush, when not in use, in a vertical position to prevent contamination of bristles from contact with surrounding surfaces. For this purpose the toothbrushes in bathrooms and other spaces are held in vertical containers, holders, etc.

A toothbrush is also known (CN 2699728Y) which is designed with a round lower end and a weight layer, such that when the toothbrush is deviated from the upright position, it returns to and stands in the substantially upright position itself, without additional containers, holders, etc. It is believed that the existing toothbrushes can be further improved.

SUMMARY OF THE INVENTION

Accordingly, it is an object of the present invention to provide a toothbrush which is a further improvement of the existing toothbrushes.

In keeping with these objects and with others which will become apparent hereinafter, one feature of the present invention resides, briefly stated, in a toothbrush, comprising a body having one end providing with a tooth-brushing element and another opposite end, said body having at least a part formed so that when the toothbrush is inclined from a vertical orientation, even close to a horizontal orientation it automatically turns back to a substantially vertical orientation to prevent a contact of said tooth-brushing element with a supporting surface on which the toothbrush is placed.

When the toothbrush is designed in accordance with the present invention, it automatically returns back to a substantially upright position, thus preventing contamination of the tooth-brushing element (bristles) from contact with the supporting surface.

In accordance with a further feature of the present invention, in order to provide the self-return of the toothbrush to the upright position from any position which can be close even to a horizontal position, a lower part of the toothbrush is formed bulb-shaped (bulbous) with an upper narrow portion and a lower wider portion having a curvilinear surface, and the weight of the lower part is selected to provide said self-return. The upper part however can be narrow and of identical width along its height.

In accordance with still a further feature of the present invention, the body of the toothbrush is composed of separate upper and lower parts, which are connected turnably relative to one another.

In accordance with another feature of the present invention in the toothbrushes said upper part is turnable between several positions including a first position in which the tooth-brushing element is located substantially at an upper location, a second position in which said tooth-brushing element faces downwardly to allow dripping from the latter, and a third position in which said tooth-brushing element is located in a lower location.

In accordance with a further feature of the invention said lower part has a recess in which said tooth-brushing element is located in said lower location, and an ultraviolet light source is associated with said recess such that said tooth-brushing element is sterilized by ultraviolet light emitted by said ultraviolet light source when said tooth-brushing element is located in said recess.

Another feature of the present invention is that said upper part is turnable relative to said lower part, and pivot means turnably connect said upper part with said lower part. The pivot means can be formed to provide a tight-fit connection between said upper and lower parts, such that said upper part can turn relative to said second part and stay in a plurality of positions by the tight fit.

An additional feature of the present invention is that the toothbrushes has a light source arranged on said body, and said light source is programmed to be on, for example, substantially only for a period of time recommended for tooth-brushing.

In accordance with the further feature, said upper part which carries the tooth-brushing element is removably connected with said lower part which forms the support, so that it can be removed from said lower part and replaced by a new upper part.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
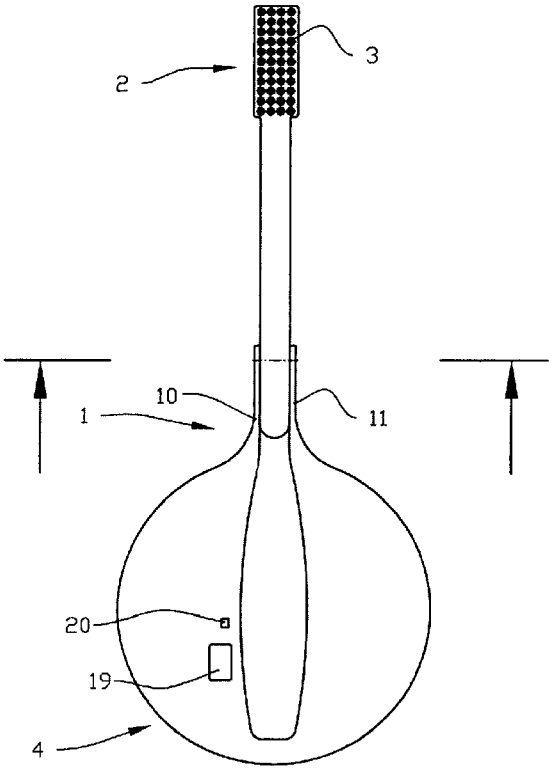
FIG. 1 is a front view of a toothbrush in accordance with the present invention.
Figure 2:
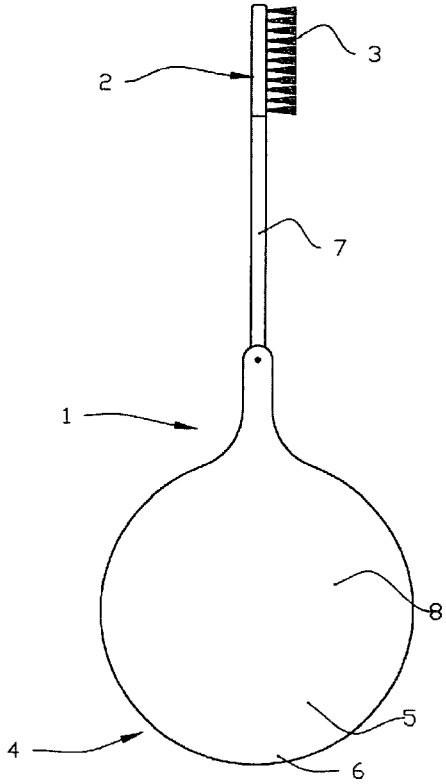
FIG. 2 is a side view of the toothbrush in accordance with the present invention.

A toothbrush in accordance with the present invention has a body which is identified as a whole with reference numeral 1. The body 1 has a first end 2 provided with a tooth-brushing element 3 formed for example by bristles, and an opposite second end 4.

The body 1 is formed so that it is kept substantially upright, and even if it is inclined close to a substantially horizontal position on a supporting surface, it turns back automatically by itself, to assume a substantially upright orientation, to prevent a contact of the tooth-brushing element 3 with unclean supporting surfaces. For this purpose an upper part 7 of the toothbrush body 1, which carries the tooth-brushing element 3 is connected with a lower part 8 which is bulb-shaped (bulbous) and has an upper narrow portion and a lower wider portion 5, a significant weight, and a low location of the center of gravity of the toothbrush body 1.

The lower wider portion 5 of the lower part 8 has a curvilinear surface, which can be formed, for example, as a part-spherical surface. This curvilinear surface can be formed by rotating of a convex generatix around a vertical axis.

Figure 3:
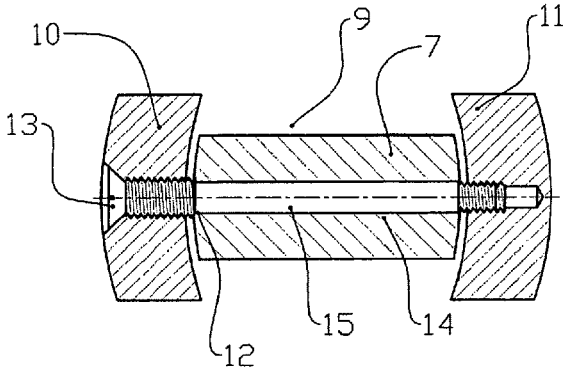
FIG. 3 is a view showing a cross-section of the toothbrush in accordance with the present invention along the line I-I in FIG. 1.

The upper part 7 and the lower part 8 can be formed as separate elements, which are connected with one another by connecting means formed for example as shown in FIG. 3. The lower portion of the upper part 7 is inserted in a gap 9 between two upper projections 10 and 11 of the lower part 8.

A threaded pin 12 with a head 13 is screwed into the projection 10, passes through an opening 14 in the upper part 7, and is screwed into the projection 11. In a portion 15 between the projections 10 and lithe threaded pin 12 can be threadless. The outer diameter of threadless portion 15 of the pin 12 and the inner diameter of the opening 14 of the upper part 7 can be selected so as to form a tight fit, for the purpose which will be explained herein below. The left and right ends of the pin 12 do not extend outwardly beyond the projections 10 and 11 to prevent any injuries to a user.

The toothbrush in accordance with the invention operates in the following manner.

A user takes the toothbrush with its hand by grasping the lower part 8 and brushes the teeth with the tooth-brushing element 3. After the tooth-brushing, the user places the toothbrush by putting a surface 6 of the lower part 8 on a supporting surface, and the toothbrush assumes an upright position and stands in this position.

Figure 4:
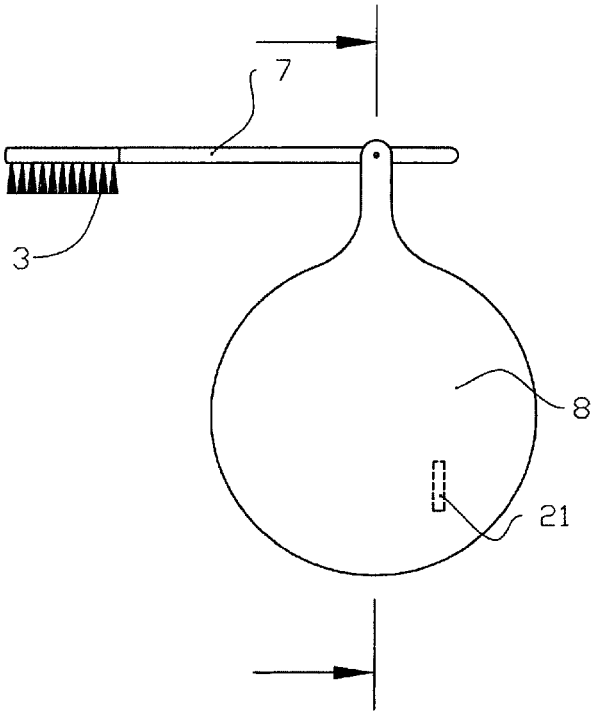
FIG. 4 is a view showing the toothbrush in accordance with the present invention with an upper part in a substantially horizontal position.

As shown in FIG. 4, the upper part 7 can be turned so that the tooth-brushing element 3 faces downwardly and residues can drip down from it. The upper part 7 is kept in this position due to the tight fit of the connecting means, which allow turning of the upper part 7 and at the same time keep it in the position shown in FIG. 4.

The upper part 7 with the tooth-brushing element 3 can be removed from the lower part 8 by unscrewing of the threaded pin 12. Then a new upper part 7 with a new tooth-brushing element 3 can be introduced between the projections 10 and 11, and the threaded pin 12 can be passed through the opening of the new upper part 7 and screwed into the projections 10 and 11.

Figure 5:
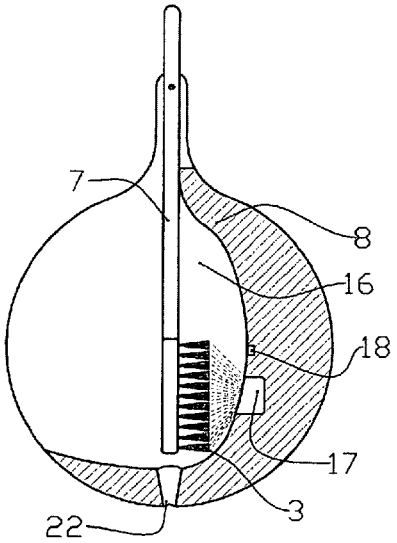
FIG. 5 is a view showing the toothbrush in accordance with the present invention with the upper part pivoted downwardly.

As shown in FIG. 5, the upper part 7 can be pivoted downward so that the tooth-brushing element 3 is received in a receptacle 16 formed in the lower part 8. In this position the tooth-brushing element 3 can be sterilized by a source of ultraviolet light 17 located in the lower part 8 and directing the ultraviolet light to the tooth-brushing element 3. The operation of the source of the ultraviolet light 17 can be triggered by a sensor 18 which senses the presence of the tooth-brushing element 3 in the receptacle 16.

A light source 19 can be also provided in the toothbrush and arranged, for example, in the lower part 8. The light source 19 can be programmed so that it emits light, for example, during the time required for brushing teeth, for example, 3 min. Thereafter it turns off automatically. The turning on of the light source 19 can be triggered for example, by a sensor 20, which senses holding of the lower part 8 by a user.

It will be understood that each of the elements described above, or two or more together, may also find a useful application in other types of constructions differing from the type described above.

While the invention has been illustrated and described as embodied in a toothbrush, it is not intended to be limited to the details shown, since various modifications and structural changes may be made without departing in any way from the spirit of the present invention.

Without further analysis, the foregoing will so fully reveal the gist of the present invention that others can, be applying current knowledge, readily adapt it for various applications without omitting features that, from the standpoint of prior art, fairly constitute essential characteristics of the generic or specific aspects of this invention.

I claim:

1. A toothbrush having a substantially vertical orientation while at rest on a supporting surface, comprising a body having one end provided with a tooth-brushing element and another opposite end, said body having at least a part configured so that when the toothbrush is inclined, even close to a horizontal position, the toothbrush automatically self erects to the substantially vertical orientation to prevent a contact of said tooth-brushing element with the supporting surface, wherein said body has an upper part and a lower part, said lower part being bulb-shaped defined by an upper narrow portion and a lower wider portion with a curvilinear surface, and a weight configured in the lower wider portion to provide said automatic self erection to the substantially vertical orientation, and said upper part is turnable between at least two positions including a first position in which said tooth-brushing element is located substantially at an upper location, and a second position in which said upper part is turned relative to said lower part and said tooth-brushing element faces downwardly to allow dripping from the latter.

2. A toothbrush as defined in claim 1, wherein said lower part has a recess in which said tooth-brushing element is located in said lower location.

3. A toothbrush as defined in claim 2, further comprising an ultraviolet light source associated with said recess such that said tooth-brushing element is sterilized by ultraviolet light emitted by said ultraviolet light source when said tooth-brushing element is located in said recess.

4. A toothbrush as defined in claim 1, further comprising an ultraviolet light source arranged on said body and operating to sterilize said tooth-brushing element.

5. A toothbrush as defined in claim 1 further comprising pivot means for turnably connecting said upper part with said lower part.

6. A toothbrush as defined in claim 5, wherein said pivot means is formed to provide tight-fit connection between said upper and lower parts, such that said upper part can turn relative to said lower part and held in a plurality of positions by the tight fit.

7. A toothbrush as defined in claim 1, further comprising a light source arranged on said body.

8. A toothbrush as defined in claim 7, wherein said light source is programmed to be activated for a predetermined time; and further comprising means for turning said light source on for said predetermined of time.

9. A toothbrush as defined in claim 1, wherein said upper part is removably connected with said lower part so that it can be removed from said lower part and replaced by another such upper part.

10. A toothbrush as defined in claim 1, wherein said upper part has a cross-section which is substantially identical along its length, while said lower bulb-shaped part has said upper narrow portion connected with said upper part and said lower wider portion.

11. A toothbrush having a substantially vertical orientation while at rest on a supporting surface, comprising a body having one end provided with a tooth-brushing element and another opposite end, said body having at least a part configured so that when the toothbrush is inclined, even close to a horizontal position, the toothbrush automatically self erects to the substantially vertical orientation to prevent a contact of said tooth-brushing element with the supporting surface, wherein said body has an upper part and a lower part, said lower part being substantially bulb-shaped defined by an upper narrow portion and a lower wider portion with a curvilinear surface, and a weight configured in the lower wider portion to provide said automatic self erection to the substantially vertical orientation, and wherein said upper part is turnable between at least two positions including a first position in which said tooth-brushing element is located substantially in an upper location, and a lower position in which said tooth-brushing element is located in a lower location.

12. A toothbrush as defined in claim 11, wherein said lower part has a recess in which said tooth-brushing element is located in said lower location.

13. A toothbrush as defined in claim 11, wherein said upper part is turnable relative to said lower part, and further comprising pivot means for turnably connecting said upper part with said lower part.

14. A toothbrush as defined in claim 11, wherein said upper part is removably connected with said lower part so that it can be removed from said lower part and replaced by another such upper part.

15. A toothbrush having a longitudinal axis orientated substantially vertical while at rest on a supporting surface, comprising a first end provided with a tooth-brushing element and an opposing second end, said body configured so that when the toothbrush is inclined, even close to a horizontal position, the toothbrush automatically self erects to the substantially vertical orientation to prevent a contact of said tooth-brushing element with the supporting surface, wherein said body has an upper part and a lower part, said lower part having an upper narrow portion and a lower wider portion, the lower wider portion including a curvilinear surface extending in a direction of the longitudinal axis, and a weight configured in the lower wider portion to provide said automatic self erection to the substantially vertical orientation, and wherein said upper part is moveable between at least two positions including a first position in which said tooth-brushing element is located substantially at an upper location, and a lower position in which said tooth-brushing element is located at a lower location of said body.

16. A toothbrush as defined in claim 15, wherein said lower part has a recess in which said tooth-brushing element is located in said lower location.

17. A toothbrush as defined in claim 15, wherein said upper part is turnable relative to said lower part, and further comprising pivot means for turnably connecting said upper part with said lower part.

18. A toothbrush as defined in claim 15, further comprising an ultraviolet light source arranged on said body and operating to sterilize said tooth-brushing element.

19. A toothbrush as defined in claim 15, further comprising a light source arranged on said body.

20. A toothbrush as defined in claim 15, wherein said upper part is removably connected with said lower part so that it can be removed from said lower part and replaced by another such upper part.

* * * * *